United States Patent [19]

Russell

[11] 4,254,836

[45] Mar. 10, 1981

[54] METHODS AND APPARATUS FOR CONTROLLING FLUID FLOW

[76] Inventor: Larry R. Russell, 6420 Hillcroft, Houston, Tex. 77081

[21] Appl. No.: 60,575

[22] Filed: Jul. 25, 1979

Related U.S. Application Data

[62] Division of Ser. No. 895,157, Apr. 10, 1978.

[51] Int. Cl.[3] ..... E21B 41/00

[52] U.S. Cl. ..... 175/65; 137/12; 175/218

[58] Field of Search ..... 137/496, 512.2, 614.17, 137/628, 12; 166/323, 325, 330, 331; 175/25, 218, 318, 65

[56] References Cited

U.S. PATENT DOCUMENTS

| | | | |
|---|---|---|---|
| 2,093,764 | 9/1937 | Lee | 175/318 X |
| 2,911,004 | 11/1959 | Whitten | 137/512.2 |
| 3,146,792 | 9/1964 | Donnelly | 137/614.17 |
| 3,363,650 | 1/1968 | Scaramucci | 137/614.17 |
| 3,861,414 | 10/1972 | Peterson | 137/517 X |
| 4,154,303 | 5/1979 | Fournier | 166/323 X |

FOREIGN PATENT DOCUMENTS 655010 7/1951 United Kingdom .

*Primary Examiner*—Robert G. Nilson
*Attorney, Agent, or Firm*—Carl B. Fox, Jr.

[57] ABSTRACT

Methods and apparatus for controlling fluid flow wherein, according to the methods, a pressure-actuated main valve is conditioned to operate by fluid pressure actuation of a pilot valve, which closes a fluid flow passage through the main valve so that the main valve may then be actuated by fluid pressure. The apparatus is a self-piloting check valve apparatus, disclosed in three embodiments, wherein dual valves are provided. One of the valves serves as a pilot valve and is shown in the form of a spring-biased check valve, closing of which permits closing of a main ball valve adapted to withstand highly elevated pressures. The sealing elements of the valve are fully protected during flow periods whereby fluid erosion is prevented. Full opening flow passages are provided through the valves in each embodiment of the apparatus.

25 Claims, 13 Drawing Figures

FIG. 10.
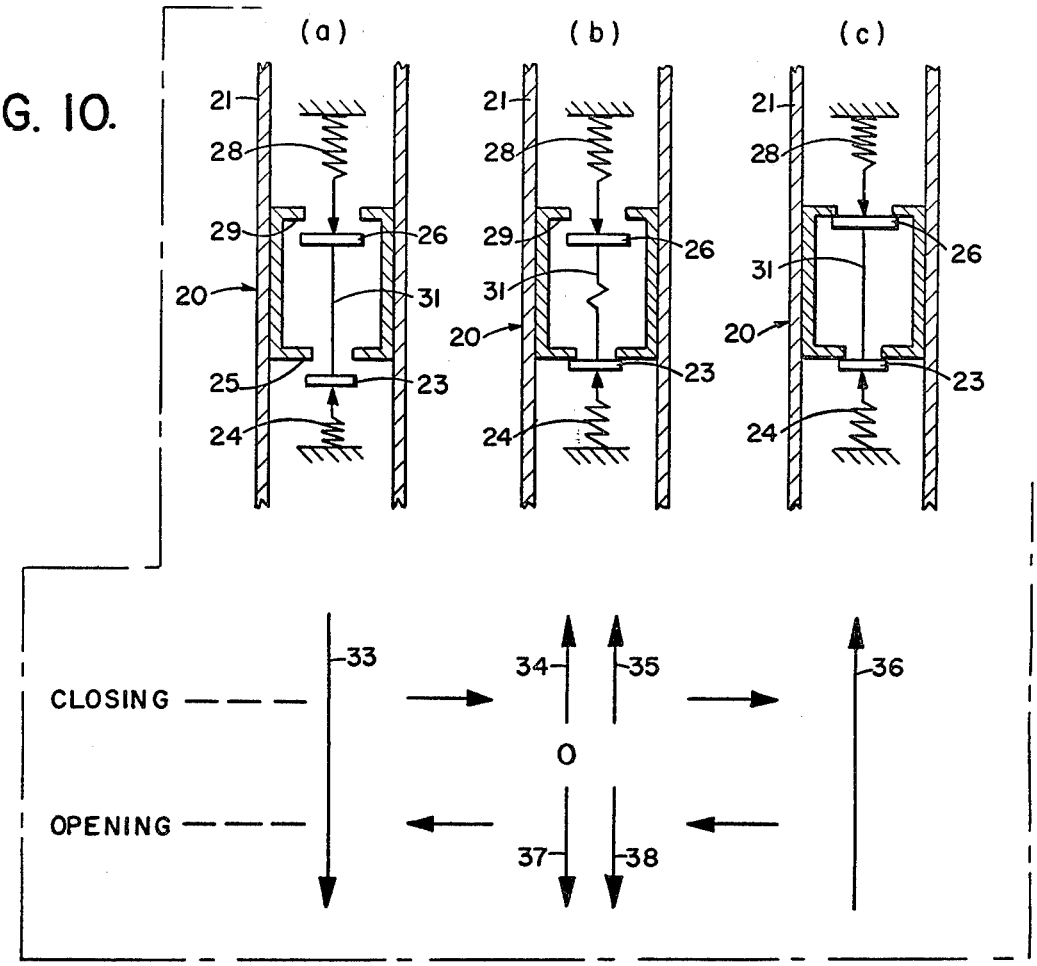
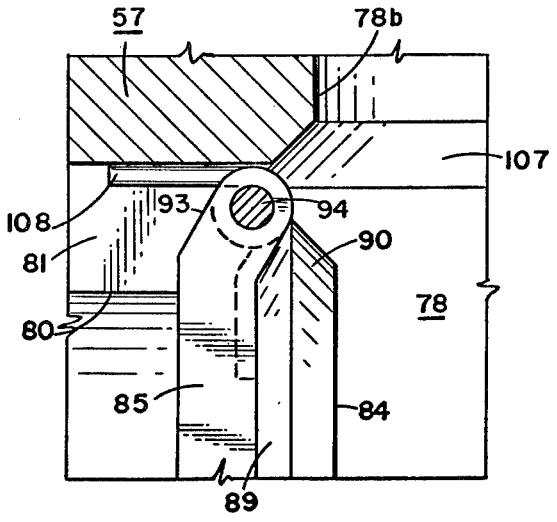
FIG. 11.

METHODS AND APPARATUS FOR CONTROLLING FLUID FLOW

This application is a division of application Ser. No. 895,157, filed Apr. 10, 1978, of the same applicant and having the same title.

BACKGROUND OF THE INVENTION

The prior art does not provide a satisfactory valve apparatus which may serve as an inside blowout preventer for use in a drill string, or which may be used as a float valve above the drilling bit in wire line coring operations, or which may be used as an upper and/or lower cock in connection with a Kelly for the purpose of minimizing use of drilling mud, or which may be used as a subsurface safety valve having a fail-safe hydraulic latch-open arrangement, or which may be employed in any other standard check valve applications in hydraulic and pneumatic systems, and which may be used in pipelines, in chemical and other processing, and in petroleum production. The valves for these purposes available in the art are subject to failure by reason of the presence of detritus or suspended solids in the flowing fluid, by reason of abrasion-cutting of valve seats and other parts, by reason of corrosion, or by reason of excessive temperature elevation of the flowing fluid. The invention provides methods through use of which the above described problems are eliminated, and in addition provides apparatus, in plural modifications, which may be utilized in accordance with the methods.

SUMMARY OF THE INVENTION

The invention provides methods for controlling fluid flow, according to which a pilot valve is provided to close the flow passage through a main valve in order that the main valve may be actuated to close in response to fluid pressure in one direction. The pilot valve may be any suitable form of check valve, such as, for example, a flapper-type check valve, a poppet-type check valve, a ball-type check valve, or a membrane sleeve type of check valve. The main valve may also be of any suitable form. In each of the embodiments of apparatus disclosed herein, the pilot valve is in the form of a flapper-type check valve which is spring-based to close, and the main valve is in the form of a ball-type valve which is spring-biased to open and which moves between its open and closed positions by rotation about eccentric pivots. The pilot valve opens readily in response to fluid flow in one direction, but closes in response to no-flow conditions or in response to flow in the opposite direction. When the pressure retained by the check valve exceeds a certain predetermined pressure, then the pressure operates to close the main valve, which is capable of retaining higher pressure differentials across the valve apparatus. According to the method, the main valve is closed in response to pressure developed because of prior closing of the pilot valve. The valve apparatus provided according to the invention is a full-opening valve, whereby wire line tools or other equipment may be passed through the valve without obstruction. The main valve seat, sealing area and seal are protected from fluid flow through the valve, and abrasion damage may not occur. Pumped-in or wire line equipment passed through the valve cannot damage the main valve seat or valve sealing area. Even though the pilot valve may become clogged or damaged and thereby caused to leak somewhat, the main valve will still close and effect a total seal. Closing action of the main valve may be controlled for slow closing or slow opening, or both, by use of a damper arrangement. Provision is made whereby the valve may be latched either in open condition or in closed condition. The pressure required for operation of the main valve may be altered to be either lower or higher so that the valve may be used under substantially any pressure conditions. The spring bias which closes the pilot valve may be made to be of any magnitude for the same purpose. The design of the apparatus is compatable with a wide range of materials for the valve components, so that selection of chemically inert seats and other valve parts is relatively simpler than for other check valve types, even in corrosive environments. The design is simple and has relatively few parts, and in one form has only four moving parts. Fabrication costs will be low, not much in excess of the cost of a standard ball valve. The method and apparatus according to the invention offer much more reliability and longer life than do other types of check valves, particularly for abrasive-charged fluid duty. The valves afforded according to the invention are relative light in weight as compared with other types of valves for the same types of service.

A principal object of the invention is to provide improved methods for controlling fluid flow. Another object of the invention is to provide such methods using a pilot valve which when operated serves as a piston to trigger operation of a fluid pressure actuated main valve. Yet another object of the invention is to provide an improved valve apparatus for use in fluid flow control. Another object of the invention is to provide such apparatus which is of the self-piloting check valve type. A further object of the invention is to provide valve apparatus wherein a check valve pilots closing of a relatively leak proof main valve, even though the pilot valve may leak. Yet another object of the invention is to provide such apparatus which is economical, light in weight, dependable, and which is fail-safe in operation.

Other objects and advantages of the invention will appear from the following detailed description of preferred embodiments of the methods and apparatus according to the invention, reference being made to the accompanying drawings.

BRIEF DESCRIPTION OF THE DRAWINGS

FIG. 10 is a schematic diagram illustrating a preferred embodiment of method according to the invention.

FIG. 11 is an enlarged partial cross-section showing the means for biasing the pilot valve.

DESCRIPTION OF THE PREFERRED EMBODIMENTS

Figure 1:
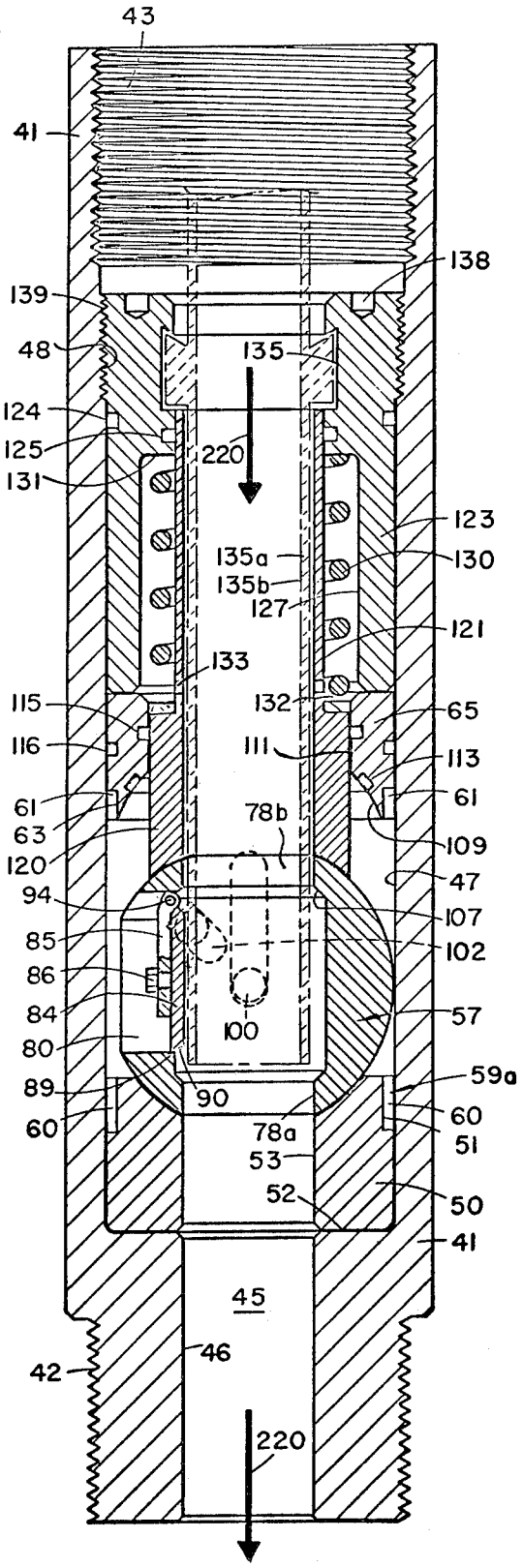
FIG. 1 is an axial cross section of a valve apparatus of preferred form according to the invention, shown in open condition with fluid flow pressure in one direction.

Referring now to the drawings in detail, the method according to the invention, in preferred embodiment, is schematically shown in FIG. 10. According to the method, a valve apparatus 20 is provided along the length of a flow conduit 21. The valve assembly 20 is provided with a pilot valve 23 which is biased as indicated at 24 to close at 25. A main valve 26 is provided which is biased to open as indicated at 28. As is indicated by line 31 which connects the pilot valve 23 to the main valve 26, the main valve 26 may be closed only when the pilot valve 23 has been closed.

Commencing with the pilot valve 23 open and with the main valve 26 also open, illustrated at (a) in FIG. 10, with fluid flow in a downward direction as indicated by arrow 33, the downward fluid flow as long as it persists will keep the pilot valve 23 in open condition against bias 24. When the downward fluid flow through conduit 21 is stopped, as indicated at 34, or when fluid flow pressure in an upward direction is instituted as indicated by arrow 35, pilot valve 23 will close first, as indicated at (b) of FIG. 10. If a no-flow condition in conduit 21 persists, the valve will remain in condition (b) with the pilot valve 23 closed and the main valve 26 open. If, however, an upflow pressure condition as indicated by arrow 35 persists, or is started, indicated by arrows 35 and 36, then the main valve 26 will close, overcoming bias 28, the pilot valve 23 remaining closed, as indicated at (c) in FIG. 10. As long as the upflow tendency persists, the valve apparatus will remain in condition (c) with both the pilot valve 23 and the main valve 26 closed.

When the upflow condition 36 is terminated and the conduit is returned to either a no-flow or downflow condition as indicated by arrows 37, 38 then the valve apparatus will be returned to condition (b) with the pilot valve 23 remaining closed (at least temporarily, until main valve 26 opens) and with bias 28 opening main valve 26. The pilot valve 23 may open before the main valve 26 has fully opened, in which case the bias 28 will complete the opening of the main valve. If a no-flow condition persists in conduit 21, the valve will remain in condition (b), with the pilot valve 23 closed but with the main valve 26 remaining open. If a downflow condition continues as indicated by arrows 38 and 33, the pilot valve 23 will be reopened by the pressure exerted by the flow, overcoming closing bias 24, the valve apparatus then being in condition (a).

This method of valve operation, as will now be understood, utilizes a pilot valve in some form which must be closed before the main valve may be closed. Under upflow pressure conditions in conduit 21, the fact that the pilot valve 23 is closed will enable the main valve to be closed by the upward fluid pressure. When downflow through conduit 21 is instituted, the bias 28 will first open the main valve, and continued downflow will open the pilot valve 23, so that unrestricted downward fluid flow may be continued. Thereafter, if upward fluid flow is commenced, or a no flow condition, then the valve will be changed to its condition (b), after which continued upflow pressure will again close the main valve as shown of condition (c) of the apparatus.

It will be noted that the pilot valve is biased to close, while the main valve is biased to open. This permits the valve operation as disclosed, with the main valve not being closed so long as the pilot valve is open, but closing of the main valve being possible after the pilot valve has been closed. The bias 28 of main valve 26 to open is preferably a rather weak bias, so that the bias 28 may be overcome and main valve 26 closed even though the pilot valve 23 may not be completely closed or may leak. If the bias 28 of the main valve 26 to close were too high, then leakage past the pilot valve might not cause closing of the main valve. If the main valve were to remain open even though the pilot valve was not completely closed, or was in a leaking condition, then fluid abrasion or abrasion caused by solids suspended in the fluid could, in the FIGS. 1–3 form of the valve, cause internal damage to the main valve 26 or to its seat, but this cannot happen when the bias 28 is of the proper low magnitude since the main valve will be closed to stop the upward fluid flow.

Referring now to FIGS. 1–3 and 7–9 of the drawings, the apparatus according to the invention includes a flow conduit 41 which serves as the valve body of the apparatus. Body 41 is shown in the form of a pipe having an external threaded connection 42 at its lower end and having an internal threaded socket connection 43 at its upward end. Body 41 may, instead, have other forms of connections at either or both of its ends. For example, internal threaded socket 43 may be replaced by external threads or by a flange connection. Lower external threaded connections 42 may be replaced by an internal threaded connection or by a flange connection. Any other suitable connections between the apparatus and other apparatuses to be connected thereto may be employed. Body 41 may be connected into a drill string or into any other piping system.

Valve body 41 has therethrough, from end to end, an internal flow passage 45, which includes a lower portion 46, an intermediate relatively enlarged portion 47, and an upper internally threaded portion 48 of the same or larger diameter as portion 47. A ball stop ring 50 having a relief 51 of rectangular crosssection annularly around its upper outer end is disposed upon annular shoulder 52 formed between passage portions 46 and 47. Ring 50 has flow passage 53 therethrough of the same diameter as passage portion 46, and has a spherically shaped seating surface 56 disposed facing upwardly around the upper end of passage 53.

Figure 2:
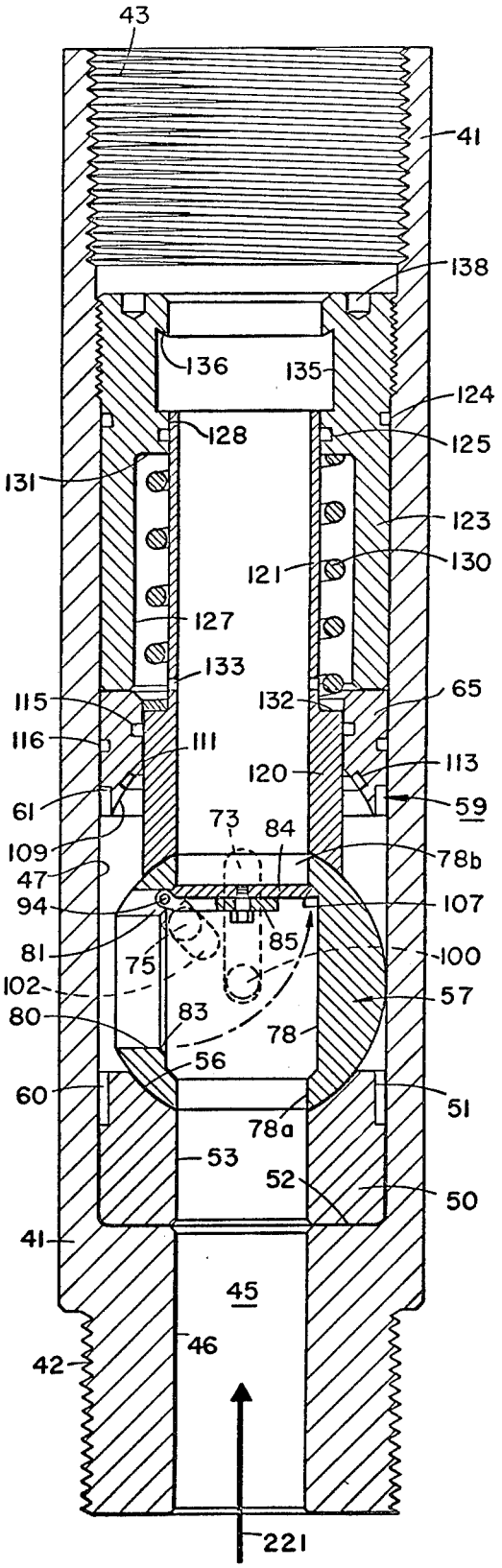
FIG. 2 is similar to FIG. 1, the valve being shown with the pilot valve in closed condition, with fluid flow pressure in the opposite direction, or with a no flow pressure condition.
Figure 7:
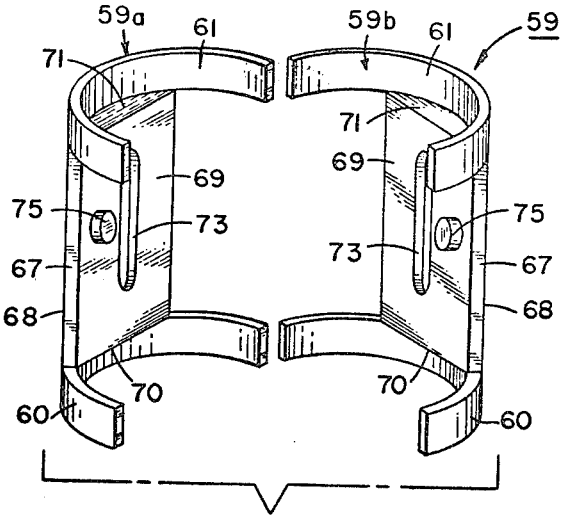
FIG. 7 is a partial perspective view, showing a valve ball cage forming a part of the apparatus.

A valve ball element 57 is shown in a position seated against seat 56 in FIGS. 1 and 2. The ball 57 is disposed within a ball support rack or cage 59, formed by two cage halves 59*a*, 59*b* as best shown in FIG. 7 of the drawings. Each cage half 59*a*, 59*b* has a lower ring formation 60 which is disposed in an annular recess 51 in stop ring 50. At its upper end, each cage half 59*a*, 59*b* has an upper ring formation 61 which is disposed in a recess 63 around the outer sides of the lower end of a ball seat ring 65. Between other ring formation 60 and upper ring formation 61, each cage half 59*a*, 59*b* has an integral connecting wall or plate 67, which is cylindrically curved at its outer surface 68 and which is flat at its inner surface 69. Transition surfaces 70, 71 are disposed at the opposite ends of the surfaces 69. A slot recess 73 is provided along the longitudinal center of each surface 69, as shown. Each surface 69 has protruding therefrom a relatively short cylindrical pin 75, these both being at the same sides of the slot recesses 73 to be in facing disposition, one to the other.

Figure 8:
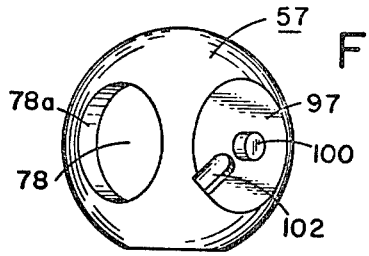
FIG. 8 is an angular side elevation showing the main valve ball according to the invention.
Figure 9:
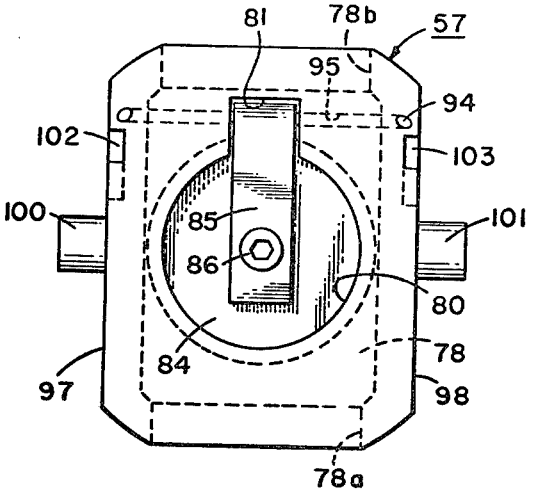
FIG. 9 is a side elevation showing another side of the valve ball shown in FIG. 8.

Referring now to FIGS. 8 and 9 of the drawings, the ball valve 57 has a passage 78 therethrough, disposed diametrically of the ball, which is of reduced diameter at its opposite ends 78*a*, 78*b*. The passage portions 78*a*, 78*b* are usually preferably of the same diameter as passages 46, 53. Ball 57 also has a transverse passage 80 at one side thereof, there being a slot 81 at the side of passage 80 in the direction of passage portion 78*b*. A rest 83, conically bevelled, is formed around the inner end of passage 80, being interrupted by the slot 81. Flapper valve disc 84 carried on arm 85, which is affixed thereto by screw 86 received in a tapped opening at the center of disc 84, has a conically bevelled surface 89 therearound adapted to abut rest 83, and is also conically bevelled at surface 90 around its opposite side. Bar 85 is slightly inturned at 93 at its end and is affixed by pin 94 received through an opening therethrough and through cylindrical openings 95 through the ball at opposite sides of slot 81. The ball has flat surfaces 97, 98 at opposite sides thereof, centrally of which are provided the projecting pins 100, 101, respectively. The surfaces 97, 98 have radially inward extending slots 102, 103, respectively, disposed at 45° angles to the passage 78.

The pins 100, 101 are slidably disposed in the opposite slots 73 of walls 67 of cage 59. The pins 75 are slidably disposed in the slots 102, 103. A conically bevelled seat surface 107 is provided around the inner end of passage portion 78. The flapper valve disc 84 may be pivotally moved about pin 94 from its position wherein its conically bevelled edge 89 is seated against seat 93 to a position wherein its opposite conically bevelled edge 90 is seated against seat 107, to close passage portion 78*b*. A spring 108, best shown in FIG. 11 of the drawings, is disposed about pin 94 at its central portion and has its opposite ends engaged against the wall of slot 81 and valve disc 84, the spring 108 biasing valve disc 84 toward its closed position against seat 107.

Seat ring 65 has a spherically countoured ringshaped seat 109 around the lower end of central passage 111 therethrough. An elastomer insert ring 113 is disposed in a circular groove around seat 109. O-ring seals 115, 116 are provided in suitable circular grooves around the interior and exterior, respectively, of ball seat ring 65. As should be clear from the drawings, ball seat ring 65 has an exterior surface adapted to be closely fitted within passage portion 47.

A ball pusher mandrel 120 is closely received through passage 111 of ball seat ring 65, sealed therearound by the O-ring seal 115 against fluid flow therepast. Mandrel 120 is outwardly relieved to be thinwalled at its upper portion 121. A retainer sleeve 123 sealed against fluid flow therepast in passage 47 by surrounding O-ring seal 124 has circular O-ring seal 125 therearound above concentric enlargment 127 of its concentric flow passage 128. Seal 125 forms a seal with thin wall portion 121 of mandrel 120. Helical compression spring 130 is disposed in passage enlargement 127 around thin-walled mandrel portion 121. The upper end of spring 130 bears against shoulder 131, and the lower end of spring 130 bears against shoulder 132 intermediate the length of mandrel 120. Fluid pressure relief ports 133 are provided through thin wall portion 121 adjacent shoulder 132.

Sleeve 123 has interior annular recess 135 around passage 128, the upper surface 136 of recess 135 being conically convergent downward, as shown. The upper end of sleeve 123 is provided with diametrically oppositely disposed bores 138 for engagement by a suitable spanner wrench employed to screw exterior threads 139 of sleeve 123 into threads 48.

The upper end of mandrel 120 is even with the lower side of recess 135 when the valve is in the condition shown in FIG. 1. A suitable fitting 135*a*, shown schematically by dashed lines in FIG. 1, and having expandable latches to engage in recess 135, may be disposed to bear against the upper end of mandrel 120, thereby preventing mandrel 120 from moving upwardly and in this way preventing valve ball 57 from being moved to its closed position shown in FIG. 3. Ball 57 may, in this manner, be locked in its open position. Fitting 135*a* has a full-bore flow passage 135*b* therethrough so that it will not impede fluid flow or passage of tools or other devices through the valve apparatus. Fitting 135*a* may have a thin-walled tubular extension downwardly past the flapper valve to additionally hold it open so that, for example, wire line tools may be run through the valve.

Valve ball 57 serves as the main valve of the apparatus. Flapper valve 84 serves as the pilot valve of the apparatus. Valve 57 is shown in open position in FIGS. 1 and 2, and is shown in closed position in FIG. 3. Valve ball 57 is moved from its open position of FIGS. 1 and 2 to its closed position of FIG. 3 by rotation of the ball by 90°, the ball rotation being caused by fluid pressure flapper valve disc 84 in its closed position as shown in FIG. 2, sufficient to move the ball against mandrel 120 to compress helical compression spring 130, the ball rotation being caused by the pin 75 engagements in the slots 102, 103 eccentrically disposed with regard to the ball center so that the ball upon moving upwardly is forced to rotate through a 90° rotation. The pins 100, 101 sliding in slots 73 stabilize the ball movements. The pins 100, 101 and slots 73 may be omitted if desired, but the stabilization of ball movement which they afford is desirable. During rotation of the ball, the pins 75 move relatively inwardly and then outwardly in the slots 102, 103.

Figure 4:
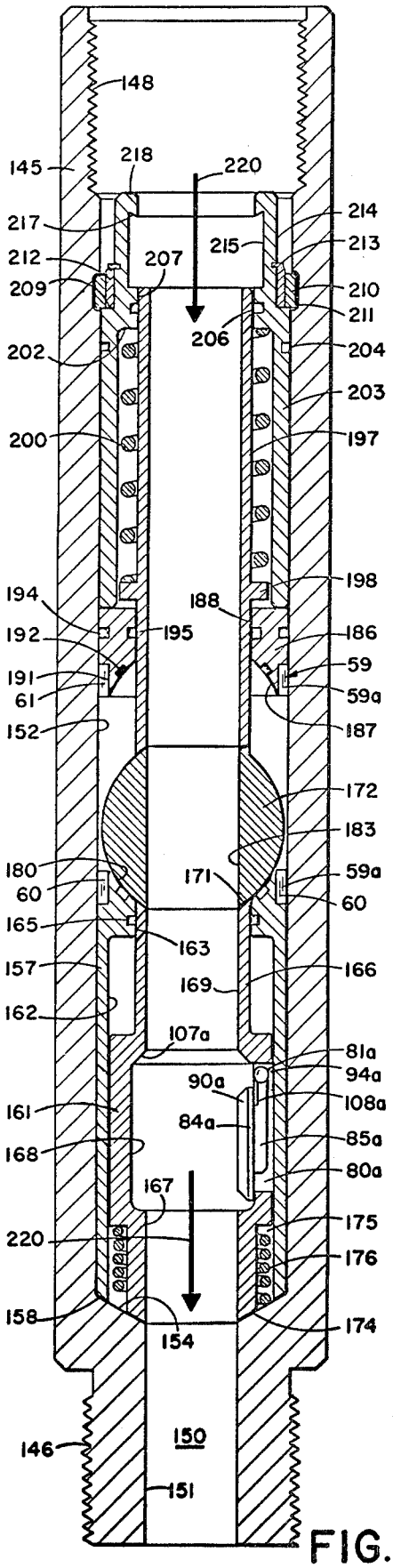
FIG. 4 is an axial cross section of a valve of modified form according to the invention, the valve being shown in open condition with fluid flow in said one direction.
Figure 5:
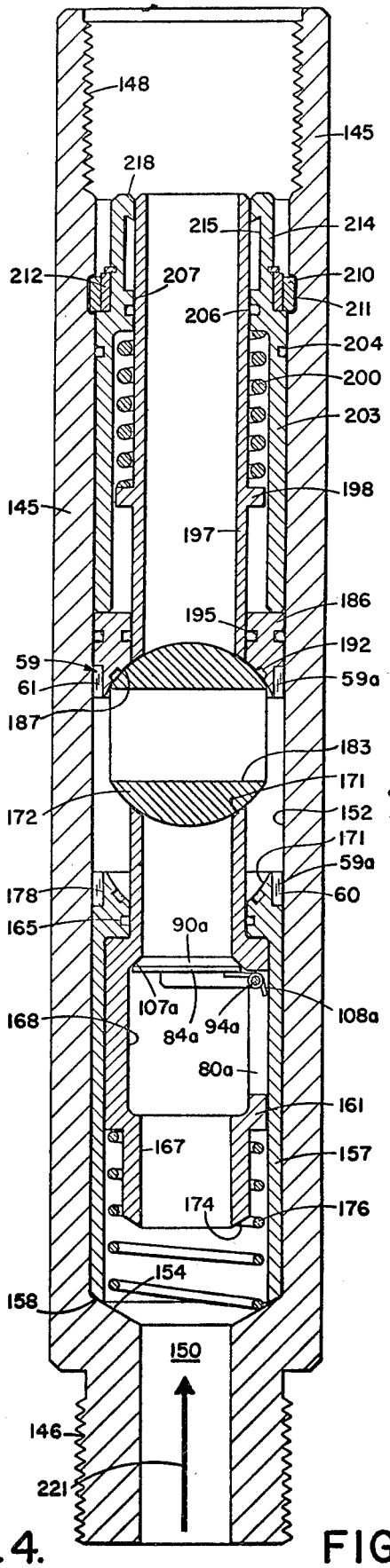
FIG. 5 is similar to FIG. 4, showing the valve in closed condition blocking fluid flow in said opposite direction.

A second embodiment of the apparatus, of modified form, is shown in FIGS. 4 and 5 of the drawings. A flow conduit 145 serves as the valve body, and has diametrically reduced exterior threads 146 at its lower end and internal threaded socket 148 at its upper end. Body 145 may be adapted to be incorporated into a drill string used in the drilling of a petroleum or other well, or into many other piping systems. Cylindrical passage 150 is of relatively smaller diameter at its lower portion 151 and is of relatively larger diameter thereabove at its portion 152. A downwardly converging conically bevelled shoulder 154 is provided at the joinder between passage portions 151, 152.

A ball stop sleeve 157 is fitted closely yet slidably within passage portion 152, and has a downwardly convergent conically bevelled end 158 which seats against shoulder 154. Flapper valve body 161 is closely yet slidably received within portion 162 of a cylindrical flow passage through pusher body 157, the flow passage being reduced at its upper portion 163. O-ring seal 165 seals between sleeve 157 and valve body 161. The wall of flapper valve body 161 is offset concentrically inwardly at 166. A continuous flow passage through body 161 is formed by lower portion 167, of the same diameter as body passage 151, concentrically enlarged portion 168, and upper portion 169, again of the same diameter as passage portion 151. The upper end of flapper valve body wall 166 is spherically formed at 171 to flushly engage the outer surface of valve ball 172. The lower end of flapper body 161 is downwardly convergently conically bevelled at 174 to flushly fit against shoulder 154. An annular recess 175 has a helical compression spring bearing against shoulder 154 and the upper end of the spring bearing against the upper side of recess 175. Spring 176 biases flapper valve body 161 in an upward direction toward its position of FIG. 5.

Valve body 161 has a circular transverse opening 80*a* at one side. A flapper valve disc 84*a* is carried by arm 85*a* which is pivotally connected to body 161 at pin 94*a* within slot 81*a*. Disc 84*a* is pivotally movable between an open position wherein the edge of one side of the disc seats around the inner end of opening 80*a*, as shown in FIG. 4, and a closed position wherein its conically bevelled surrounding seat 90*a* is seated against conically bevelled seat 107*a* between passage portions 168, 169, as shown in FIG. 5. Disc 84*a* is biased to closed position against seat 107*a* by spring 108*a*.

Figure 3:
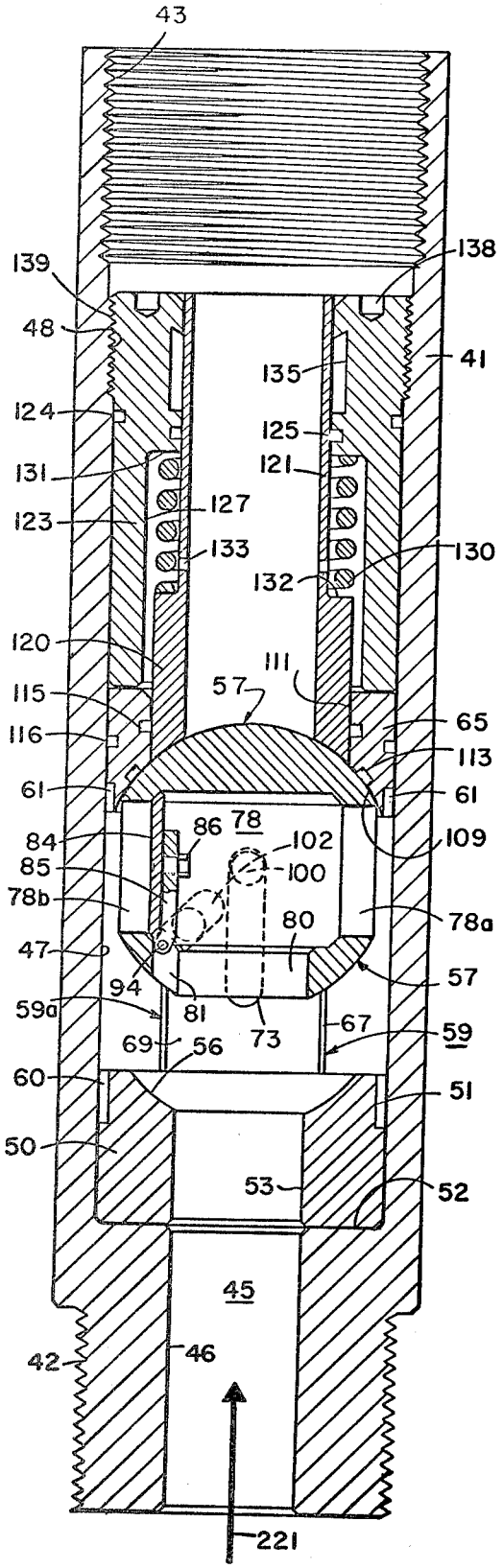
FIG. 3 is similar to FIGS. 1 and 2, showing the valve in completely closed condition, blocking fluid flow in the opposite direction.

A ball valve cage 59, as in the FIG. 1–3 embodiment, is disposed with its lower ring portions 59*a*, 59*b* disposed in an annular recess 178 around the upper exterior end of ball stop sleeve 157. Sleeve 157 has a spherically formed seat 180 to engage ball 172 and which forms a continuation of surface 171 when the flapper valve body 161 is in its lower position as shown in FIG. 4. Valve ball 172 has therethrough a flow passage 183 of substantially the same diameter as flow passages 167, 169. The valve ball 172 is provided with flat surfaces corresponding to surfaces 97, 98 of the FIG. 1–3 embodiment at opposite sides thereof, a short pin projecting from each of these flat surfaces, one at each of opposite sides of the valve ball. Each of these pins is slidably disposed in a slot 73 of the cage or rack 59. The ball 172 is externally of the same design as ball 57 of FIG. 1 and is moved upwardly and rotated 90° to closed position by force applied thereto from below, as has been particularly explained for the FIGS. 1–3 embodiment.

Main ball valve seat body 186 is in the form of a ring having a spherically formed seat 187 concentrically formed around the lower end of passage 188. An annular recess 191 around the lower outer edge of seat 186 receives upper ring formations 59*a*, 59*b* of cage 59. Ring shaped elastomeric seal 192 is disposed in a circularly formed groove around seat 187. O-ring seals 194, 195 are disposed in grooves respectively outwardly and inwardly of seat body 186, these sealing respectively between valve body 145 and seat body 186, and between seat body 186 and a tubular upper ball pusher mandrel 197. Mandrel 197 has therearound an outwardly disposed integral collar formation 198 against the upper side of which the lower end of a helical compression spring 200 is disposed. The upper end of compression spring 200 bears against shoulder 202 of retainer sleeve 203. An O-ring seal 204 disposed in a suitable groove around the outer circumference of retainer sleeve 203 seals between the retainer sleeve and the interior of valve body 145. An O-ring seal 206 seals between reduced passage 207 of the retainer sleeve and the exterior of sleeve 197. Retainer sleeve 203 has an upward facing shoulder 209 against which is disposed the inner portion of surrounding split retainer ring 210. Split retainer ring 210 is received at its outer surfaces within a groove 211 around the interior of passage 152. A continuous, non-split, ring 212 is disposed annularly within split ring 210, preventing inward movement of split ring 210. A snap ring 213 is disposed in a groove around the outer surface of portion 214 of retainer ring 203 to hold ring 212 fixed in place. The inner surface of ring 212 is engaged with the outer surface of portion 214 of retainer ring 203, portion 214 being offset concentrically inwardly. A latch detent groove 215 having downwardly convergent conically tapered upper end 217 is formed interiorly around the upper end portion 214, spaced below upper end 218 thereof. Groove 215 is adapted to engage a tool or other device which might be desired to be latched to the apparatus. For example, a fitting 135*a*, FIG. 1, may extend inwardly past the end of sleeve 197 blocking against upward movement, thereby locking the main valve ball 172 against opening.

No bleeder port, such as the bleeder port 133 of ball retainer or holddown mandrel 120 in FIGS. 1–3, is provided through ball retainer or holddown mandrel 197. Fluid leakage may occur past collar formation 198 (either the fluid flowing through the apparatus, or air or other fluid trapped outside of mandrel 197 during assembly), and the chamber within which spring 200 is disposed is of constant volume so that no bleeder port therefrom is necessary.

Referring now again to FIGS. 1–3, it should be noted that when the valve is in the FIG. 1 condition, the seat 109 is completely protected by retainer mandrel 120. The righthand surface of ball 57 which seats against seat 109 is likewise out of the flow stream and protected. The lower end surface of mandrel 120 is likewise protected. Therefore, no fluid flow erosion or abrasion caused by liquid or gas or entrained material can occur when the valve is in full open condition as in FIG. 1. The flow passage through the valve in the FIG. 1 condition is a full open flow passage, whereby tools and other apparatuses may be readily passed therethrough.

In the FIGS. 1–3 embodiment, pilot valve disc 84 is biased toward closing at seat 107 by spring 108. The main ball valve 57 is biased against closing by the pressure of spring 130. When fluid is flowing downwardly, as indicated by arrows 220 in FIG. 1, the flapper disc 84 is moved to open position by the fluid pressure, spring 108 being overcome by the pressure. When flow is changed to an upward direction, as indicated by arrow 221 in FIG. 2, or when a no flow condition exists with flow in neither direction, disc 84 moves to closed position against seat 107 biased to such position by spring 108. Then, if flow pressure continues in an upward direction, for example the pressure from a well being drilled by the drill string apparatus, the pressure against valve disc 84, acting through elements 57 and 120, compresses spring 130, moving mandrel 120 upwardly, and the ball 57 rotates upwardly about the pins 75 to the position shown therefor in FIG. 3. The disc 84 will remain closed at seat 107 because of the bias of spring 108. When the valve is in the FIG. 3 condition, flow upwardly through passage 45 is completely stopped, and the valve is sealed by circular seal 113 to be completely leak free. Even though, with the valve in the condition of FIG. 2, the disc 84 may leak somewhat, nonetheless the flow pressure drop across the check valve will cause movement of the ball to the position of FIG. 3, to close the main valve.

Similarly, referring to the FIGS. 4–5 embodiment, the disc 84a is shown in open position in FIG. 4, and is biased toward its closed position, so that when either a no-flow or an upward flow condition exists, the disc will move to against seat 107a, and thereafter, if the pressure below disc 84a exceeds the pressure above disc 84a by a sufficient amount, the mandrel 161 will move upwardly causing mandrel 197 to also be moved upwardly compressing spring 200, and the valve ball 172 will rotate upwardly about pins 75 to seat at seat 187. Again, in this form of valve apparatus, the seat 187 and the surface of ball 172 which engages seat 187 are both protected when the valves are opened, so that no abrasion or erosion of any sealing surface may occur. When the valve is closed, as in FIG. 5, a fluidtight seal is maintained by seal ring 192 whereby no leakage will occur.

It should be realized, that although both the FIGS. 1–3 and the FIGS. 4–5 embodiments disclose full opening valves, the pilot valve being a flapper disc type of valve and the main valve being a ball valve type of valve, that according to the methods of the invention the pilot valve may be of another type, such as a poppet-type valve, a ball-type valve, or a membrane sleeve check valve. The main valve may also be one of these other types of valves according to the methods of the invention.

The invention provides a very dependable valve apparatus which is virtually foolproof in operation, which is of relatively inexpensive design, and which is of relative light weight. The other advantages of the valve heretofore mentioned are shown to be accomplished by the embodiments of the apparatus herein disclosed.

Figure 6:
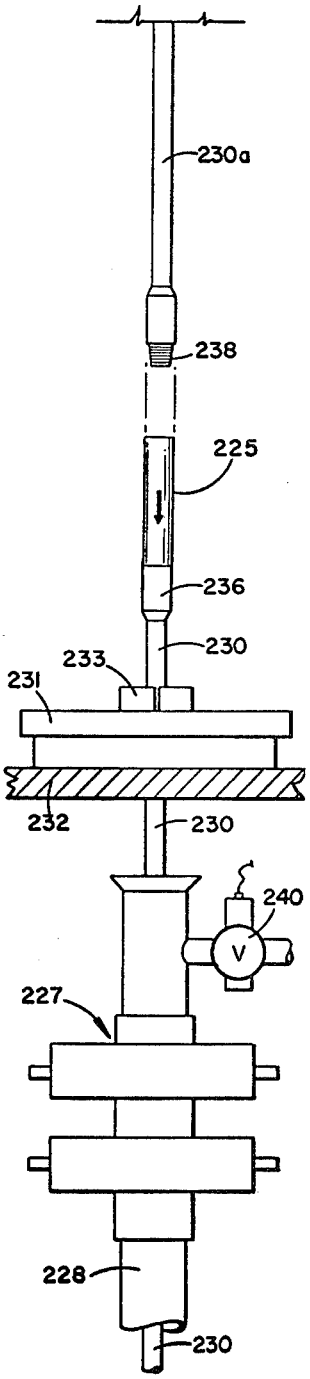
FIG. 6 is a schematic drawing illustrating the use of the valve apparatus in conjunction with a well drilling assembly.

FIG. 6 of the drawings shows the valve apparatus disposed for use in a drill string assembly. Reference numeral 225 indicates the valve apparatus, which may be either the FIGS. 1–3 embodiment of the apparatus or the FIGS. 4–5 embodiment of the apparatus. A well control unit 227, of any suitable form, controls well pressures in the casing or casings 228 lining the well bore, and controls pressures around the drill string 230 which passes through unit 227 into the well bore. Unit 227 may also serve to prevent the drill string from being blown out of the well bore by sub-surface pressures. The drill string 230, at its upper end, passes through a rotary table 231 supported upon the derrick floor 232, being supported by pipe slips 233 at the rotary table. Box 236 at the upper end of the drill string has the lower threads 42 or 146 of the valve apparatus 225 screwed thereinto, and there is shown an additional drill pipe joint 230a, having threaded pin 238 at its lower end adapted to be screwed into upper threaded socket 43 or 148 of the valve apparatus.

During drilling of the well, drilling fluid will be pumped into the well bore through drill string 130, exiting therefrom at the drill bit at the lower end of the drill string. The drilling fluid will pass upwardly around the drill string in the casing lining the well bore, to be removed through valve 240 for disposal or re-use, carrying drilling cuttings from the well.

In this situation, the valve apparatus 225 serves as an inside blowout preventer for the drill string, to retain pressured fluid which might be developed from a well formation from rising through the drill string. The valve apparatus may be used in many other applications, some of which have been mentioned, and others of which will be realized by those skilled in the art.

Figure 12:
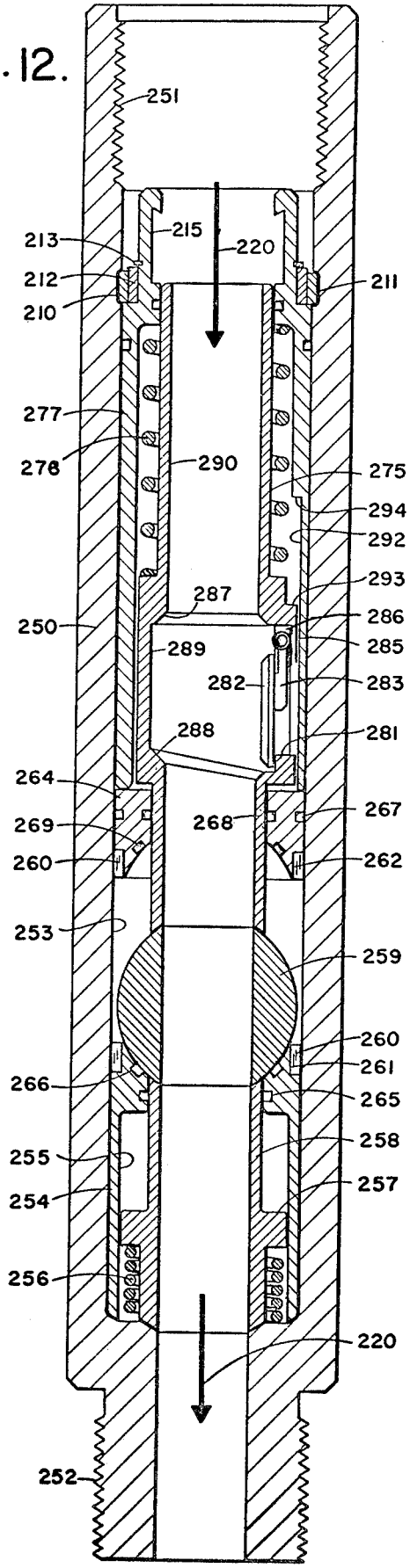
FIGS. 12–13 are axial cross sections of another form of valve according to the invention, the valve being shown in open condition in FIG. 12 and being shown in closed condition in FIG. 13.
Figure 13:
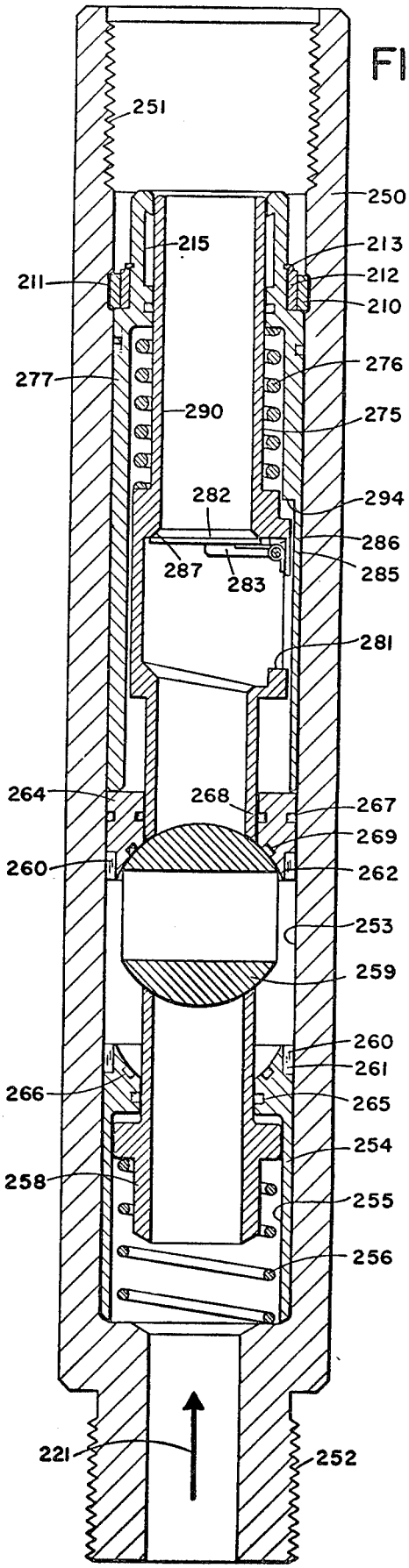

An additional form of valve according to the invention is shown in FIGS. 12–13. Body 250 has upper threaded socket 251, lower external threads 252, and passage 253 therebetween. Sleeve 254 has annular recess 255 receiving helical compression spring 256 and surrounding annular collar 257 of tubular body 258. Ball 259 is within rack or cage 260. The lower end of cage 260 is received in annular recess 261, and the upper end of cage 260 is received in annular recess 262 of seat ring 264. O-ring seals 265–268 are provided, as shown. Sealing ring 269 seals between ball 259 and the seat when the valve is closed. Ball 259 and cage 260 are the same as in the FIGS. 4–5 embodiment. Mandrel 275 is biased downwardly by compression spring 276 acting between the mandrel 275 and sleeve 277. Sleeve 277 is held down by rings 210, 212, 213, as in the FIGS. 4–5 embodiment, and has recess 215 as in that embodiment.

Enlarged portion 280 of mandrel 275 has side opening 281 over which pilot flapper valve 282 carried by arm 283 is disposed when open, the arm being pivotally connected by pin 285 in slot 286 in the manner before described. Seat 287 is sealingly engaged by valve 282 when the valve is closed. Angular bevel surface 288 is provided at the lower end of annular enlargement 289 of mandrel passage 290.

The wall of sleeve 277 is thinned at 292, and recess 293 in mandrel 275 permits full upward movement of mandrel 275 with regard to shoulder 294.

Ball 259 has pins 184 slidably disposed in grooves 73 of the cage 260, and cage 260 has pins 75 slidably disposed in slots of the ball, to control ball movements and to support the ball, as heretofore explained.

Operation and use of the apparatus of FIGS. 12–13 will be apparent from the descriptions of the other embodiments, and further description thereof is not necessary.

While preferred embodiments of the methods and apparatus have been described and shown in the drawings, many modifications thereof may be made by persons skilled in the art without departing from the spirit of the invention, and it is intended to protect by Letters Patent all forms of the invention falling within the scope of the following claims.

I claim:

1. Method for control of fluid flow through a conduit, comprising providing a pilot valve in the conduit which is normally closed when no fluid is flowing through the conduit and which is closed when fluid is flowing through the conduit in one direction and which is moved to open when fluid is flowing through the conduit in the opposite direction, providing a main valve having a straight open fluid flow passage therethrough in the conduit which is normally open when no fluid is flowing through the conduit and which is open when fluid is flowing through the conduit in said opposite direction and which is moved to close by a fluid pressure gradient in the conduit in said one direction when said pilot valve is closed, opening said pilot valve by flowing fluid through the conduit in said opposite direction with said main valve remaining open during such flow, and closing said pilot valve and said main valve by flowing fluid through the conduit in said one direction, said pilot valve when open having an open flow passage therethrough in line with said fluid flow passage through said main valve.

2. Method according to claim 1, including blocking said main valves against closing when it is not desired that said valves should close against fluid flow through said conduit in said one direction.

3. Method according to claim 1, wherein said pilot valve is provided in the form of a check valve biased to close against fluid flow in said one direction, and wherein said main valve is provided in the form of a valve biased toward its open position.

4. Method according to claim 3, including blocking said valves against closing when it is not desired that said valves should close in response to fluid flow through said conduit in said one direction.

5. Method according to claim 3, wherein said pilot valve is biased to close by spring means, and wherein said main valve is biased to open by spring means.

6. Method according to claim 5, including blocking said valves against closing when it is not desired that said valves should close in response to fluid flow through said conduit in said one direction.

7. Method according to claim 5, wherein said spring means which biases said main valve toward its open position is positioned to act against a mandrel sleeve which bears against said main valve to hold it in its open position.

8. Method according to claim 7, including blocking said valves against closing when it is not desired that said valves should close in response to fluid flow in said one direction.

9. Method according to claim 1, including connecting said conduit into a drill pipe through which drilling fluid flows during drilling of a well, flowing drilling fluid down said drill pipe in said opposite direction during drilling of the well, and preventing blowout from the well by the closing of said pilot valve and said main valve when blowout through the drill string commences.

10. Method for operating a valve having a straight open fluid flow passage therethrough through which fluid flows when the valve is open, comprising closing the fluid flow passage through the valve by means of a check valve which completely unrestricts the fluid flow passage through the valve when the check valve is open, and closing the valve by imposition of fluid pressure thereagainst in a valve closing direction while the check valve is closed.

11. Method according to claim 10, including biasing said valve toward open condition, whereby the valve will be open when said fluid flow passage therethrough is not closed and when said fluid pressure is insufficient to overcome said bias.

12. Method according to claim 11, including biasing said valve toward open condition by imposing a spring force thereagainst.

13. Method according to claim 12, including imposing said spring force against said valve though slidable sleeve means disposed against said valve, said sleeve means being slidably moved to overcome said spring force when said valve is closed by said imposition of fluid pressure thereagainst in said valve closing direction.

14. Method according to claim 13, including biasing said check valve to close when no fluid is flowing through the valve, said check valve being opened by fluid flowing through the valve in the opposite direction.

15. Method according to claim 14, including providing said check valve bias by spring means.

16. Method according to claim 15, including biasing said valve toward open condition, whereby the valve will be open when said fluid flow passage therethrough is not closed and when said fluid pressure is insufficient to overcome said bias.

17. Method according to claim 16, including biasing said valve toward open condition by imposing a spring force thereagainst.

18. Method according to claim 17, including imposing said spring force against said valve through slidable sleeve means disposed against said valve, said sleeve means being slidably moved to overcome said spring force when said valve is closed by said imposition of fluid pressure thereagainst in said valve closing direction.

19. Method according to claim 18, including blocking said valve against closing when it is not desired that said valve should be closed.

20. Method for control of fluid flow through a conduit, comprising providing a pilot valve in the conduit which is normally closed when no fluid is flowing through the conduit and which is closed when fluid is flowing through the conduit in one direction and which is moved to open when fluid is flowing through the conduit in the opposite direction, providing a main valve in the conduit which is normally open when no fluid is flowing through the conduit and which is open when fluid is flowing through the conduit in said opposite direction and which is moved to close by a fluid pressure gradient in the conduit in said one direction when said pilot valve is closed, opening said pilot valve by flowing fluid through the conduit in said opposite direction with said main valve remaining open during such flow, closing said pilot valve and said main valve by flowing fluid through the conduit in said one direction, and including blocking said main valve against closing when it is not desired that said valve should close against fluid flow through said conduit in said one direction.

21. Method for control of fluid flow through a conduit, comprising providing a pilot valve in the conduit which is normally closed when no fluid is flowing through the conduit and which is closed when fluid is flowing through the conduit in one direction and which is moved to open when fluid is flowing through the conduit in the opposite direction, providing a main valve in the conduit which is normally open when no fluid is flowing through the conduit and which is open when fluid is flowing through the conduit in said opposite direction and which is moved to close by a fluid pressure gradient in the conduit in said one direction when said pilot valve is closed, opening said pilot valve by flowing fluid through the conduit in said opposite direction with said main valve remaining open during such flow, and closing said pilot valve and said main valve by flowing fluid through the conduit in said one direction, wherein said pilot valve is provided in the form of a check valve biased to close against fluid flow in said one direction, and wherein said main valve is provided in the form of a valve biased toward its open position, and including blocking said valves against closing when it is not desired that said valves should close in response to fluid flow through said conduit in said one direction.

22. Method for control of fluid flow through a conduit, comprising providing a pilot valve in the conduit which is normally closed when no fluid is flowing through the conduit and which is closed when fluid is flowing through the conduit in one direction and which is moved to open when fluid is flowing through the conduit in the opposite direction, providing a main valve in the conduit which is normally open when no fluid is flowing through the conduit and which is open when fluid is flowing through the conduit in said opposite direction and which is moved to close by a fluid pressure gradient in the conduit in said one direction when said pilot valve is closed, opening said pilot valve by flowing fluid through the conduit in said opposite direction with said main valve remaining open during such flow, and closing said pilot valve and said main valve by flowing fluid through the conduit in said one direction, wherein said pilot valve is provided in the form of a check valve biased by spring means to close against fluid flow in said one direction, and wherein said main valve is provided in the form of a valve biased by spring means toward its open position, and including blocking said valves against closing when it is not desired that said valves should close in response to fluid flow through said conduit in said one direction.

23. Method for control of fluid flow through a conduit, comprising providing a pilot valve in the conduit which is normally closed when no fluid is flowing through the conduit and which is closed when fluid is flowing through the conduit in one direction and which is moved to open when fluid is flowing through the conduit in the opposite direction, providing a main valve in the conduit which is normally open when no fluid is flowing through the conduit and which is open when fluid is flowing through the conduit in said opposite direction and which is moved to close by a fluid pressure gradient in the conduit in said one direction when said pilot valve is closed, opening said pilot valve by flowing fluid through the conduit in said opposite direction with said main valve remaining open during such flow, and closing said pilot valve and said main valve by flowing fluid through the conduit in said one direction, wherein said pilot valve is provided in the form of a check valve biased by spring means to close against fluid flow in said one direction, and wherein said main valve is provided in the form of a valve biased by spring means toward its open position, wherein said spring means which biases said main valve toward its open position is positioned to act against a mandrel sleeve which bears against said main valve to hold it in its open position, and including blocking said valves against closing when it is not desired that said valves should close in response to fluid flow in said one direction.

24. Method for control of fluid flow through a conduit, comprising providing a pilot valve in the conduit which is normally closed when no fluid is flowing through the conduit and which is closed when fluid is flowing through the conduit in one direction and which is moved to open when fluid is flowing through the conduit in the opposite direction, providing a main valve in the conduit which is normally open when no fluid is flowing through the conduit and which is open when fluid is flowing through the conduit in said opposite direction and which is moved to close by a fluid pressure gradient in the conduit in said one direction when said pilot valve is closed, opening said pilot valve by flowing fluid through the conduit in said opposite direction with said main valve remaining open during such flow, and closing said pilot valve and said main valve by flowing fluid through the conduit in said one direction, including connecting said conduit into a drill pipe through which drilling fluid flows during drilling of a well, flowing drilling fluid down said drill pipe in said opposite direction during drilling of the well, and preventing blowout from the well by the closing of said pilot valve and said main valve when blowout through the drill string commences.

25. Method for operating a valve having a fluid flow passage therethrough through which fluid flows when the valve is open, comprising closing the fluid flow passage through the valve by means of a check valve, and closing the valve by imposition of fluid pressure thereagainst in a valve closing direction, including biasing said check valve to close when no fluid is flowing through the valve by spring biasing means, said check valve being opened by fluid flowing through the valve in the opposite direction, including biasing said valve toward open condition by imposing a spring force thereagainst whereby the valve will be open when said fluid flow passage therethrough is not closed and when said fluid pressure is insufficient to overcome said bias, said spring force against said valve being imposed through slidable sleeve means disposed against said valve and said sleeve means being slidably moved to overcome said spring force when said valve is closed by said imposition of fluid pressure thereagainst in said valve closing direction, and including blocking said valve against closing when it is not desired that said valve should be closed.

* * * * *

UNITED STATES PATENT OFFICE
CERTIFICATE OF CORRECTION

PATENT NO. : 4,254,836
DATED : March 10, 1981
INVENTOR(S) : Larry R. Russell

It is certified that error appears in the above-identified patent and that said Letters Patent are hereby corrected as shown below:

Column 4, line 67, change "other" to --lower--.

Column 6, line 35, after "pressure" insert --against--.

Column 9, line 56, change "130" to --230--.

Signed and Sealed this

*Twenty-eighth* Day of *July 1981*

[SEAL]

*Attest:*

GERALD J. MOSSINGHOFF

*Attesting Officer*

*Commissioner of Patents and Trademarks*